US011800926B2

(12) United States Patent
Leng

(10) Patent No.: US 11,800,926 B2
(45) Date of Patent: Oct. 31, 2023

(54) DUAL-PURPOSE FOLDING TABLE

(71) Applicant: New-Tec Integration (Xiamen) Co., Ltd., Xiamen (CN)

(72) Inventor: Luhao Leng, Xiamen (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 0 days.

(21) Appl. No.: 17/897,315

(22) Filed: Aug. 29, 2022

(65) Prior Publication Data

US 2022/0408910 A1 Dec. 29, 2022

Related U.S. Application Data

(63) Continuation of application No. PCT/CN2021/077704, filed on Feb. 24, 2021.

(30) Foreign Application Priority Data

Feb. 27, 2020 (CN) ..... 202020219135.8
Jul. 21, 2020 (CN) ..... 202021448677.9

(51) Int. Cl.
*A47B 3/02* (2006.01)
*A47B 3/091* (2006.01)
*A47B 5/04* (2006.01)

(52) U.S. Cl.
CPC ..... *A47B 3/02* (2013.01); *A47B 3/0915* (2013.01); *A47B 5/04* (2013.01)

(58) Field of Classification Search
CPC ..... A47B 3/02; A47B 3/0915; A47B 5/04
(Continued)

(56) References Cited

U.S. PATENT DOCUMENTS 846,105 A * 3/1907 Harris ..... D06F 81/02 108/145
3,053,396 A * 9/1962 Brown ..... A47B 7/02 211/27

(Continued)

FOREIGN PATENT DOCUMENTS

CN 2269114 Y 12/1997
CN 2313450 Y 4/1999

(Continued)

OTHER PUBLICATIONS

International Search Report and English Translation cited in PCT/CN2021/077704, dated Jun. 1, 2021, 10 pages.

(Continued)

*Primary Examiner* — Daniel J Troy
*Assistant Examiner* — Timothy M Ayres
(74) *Attorney, Agent, or Firm* — COOPER LEGAL GROUP, LLC

(57) ABSTRACT

A dual-purpose folding table comprises a table board and two supporting frames. An upper portion of an outer leg pipe is pivotally connected to a rear portion of a side of the table board. A front portion of a bottom surface of the table board comprises a blocking portion corresponding to an inner leg pipe. The two supporting frames comprise a hook structure. The outer leg pipe is sleeved with a sliding sleeve located above a rotation point of the inner leg pipe and the outer leg pipe. A supporting rod is connected between a middle portion of the side of the table board and the sliding sleeve. Two ends of the supporting rod are pivotally connected to the sliding sleeve and the table board. The sliding sleeve is disposed with a locking member for locking the sliding sleeve to the outer leg pipe.

13 Claims, 18 Drawing Sheets

(58) Field of Classification Search
USPC ..... 108/119
See application file for complete search history.

(56) References Cited

U.S. PATENT DOCUMENTS

| | | | | |
|---|---|---|---|---|
| 3,134,192 | A * | 5/1964 | Huffer | A47B 19/08 248/463 |
| 3,349,727 | A * | 10/1967 | Schroer | A47B 3/02 108/119 |
| 7,207,623 | B2 * | 4/2007 | Milinov | A47C 13/00 297/124 |
| 7,571,686 | B2 | 8/2009 | Stanford | |
| 7,640,869 | B2 * | 1/2010 | Leng | A47B 9/16 108/120 |
| 9,609,943 | B1 * | 4/2017 | Lin | A47C 4/14 |
| 10,342,339 | B2 * | 7/2019 | Chen | A47C 13/00 |
| 2008/0078893 | A1 * | 4/2008 | Chianale | B25H 1/04 248/129 |
| 2008/0105171 | A1 | 5/2008 | Stanford | |

FOREIGN PATENT DOCUMENTS

| | | | |
|---|---|---|---|
| CN | 1252249 | A | 5/2000 |
| CN | 2503768 | Y | 8/2002 |
| CN | 2691362 | Y | 4/2005 |
| CN | 204378475 | U | 6/2015 |
| CN | 206482224 | U | 9/2017 |
| EP | 3001929 | A1 | 4/2016 |
| JP | 2001314238 | A | 11/2001 |

OTHER PUBLICATIONS

Written Opinion cited in PCT/CN2021/077704, dated Jun. 1, 2021, 7 pages.

* cited by examiner

DUAL-PURPOSE FOLDING TABLE

RELATED APPLICATIONS

This application is a continuation of international patent application number PCT/CN2021/077704, filed on Feb. 24, 2021, which claims priority to Chinese patent application number 202020219135.8, filed on Feb. 27, 2020, and Chinese patent application number 202021448677.9, filed on Jul. 21, 2020. International patent application number PCT/CN2021/077704, Chinese patent application number 202020219135.8, and Chinese patent application number 202021448677.9 are incorporated herein by reference.

FIELD OF THE DISCLOSURE

The present disclosure relates to a dual-purpose folding table.

BACKGROUND OF THE DISCLOSURE

Since a table board of a folding table is rotatably connected to a table leg of the folding table, the table board can be folded, and the folding table can be placed against a wall to save space when the folding table is not in use. However, when the folding table is opened for use, the folding table can only be placed on a ground. Nowadays, people's living space is getting smaller and smaller, especially for the residents of apartment buildings. After opening the folding table, the space becomes more crowded and inconvenient to use. The function of the folding table is singular. Moreover, in daily life, the folding table is often unstable when placed against the wall, the folding table easily slips, and the folding table is inconvenient for a user to clean the floor.

BRIEF SUMMARY OF THE DISCLOSURE

The present disclosure provides a dual-purpose folding table to solve the deficiencies in the background. In order to solve the technical problem, a technical solution of the present disclosure is as follows.

A dual-purpose folding table comprises a table board, and two supporting frames. The two supporting frames are symmetrically disposed on a left side and a right side of the table board. Each of the two supporting frames comprises an outer leg pipe and an inner leg pipe connected to the outer leg pipe in an X-shaped rotatable connection. An upper portion of the outer leg pipe is pivotally connected to a rear portion of a corresponding side of the table board, and a front portion of a bottom surface of the table board comprises a blocking portion configured to correspond to the inner leg pipe. When the two supporting frames are in an opened state, the blocking portion is configured to inhibit movement of the inner leg pipe. The two supporting frames comprise a hook structure. One or more of the outer leg pipes are respectively sleeved with one or more sliding sleeves located above a rotation point at which the inner leg pipe is connected to the outer leg pipe. One or more supporting rods are connected between a middle portion of a side, which is adjacent to the one or more sliding sleeves, of the table board and the one or more sliding sleeves, and two ends of the one or more supporting rods are respectively pivotally connected to the one or more sliding sleeves and the table board. The one or more sliding sleeves are disposed with a locking member configured to enable the one or more sliding sleeves to be locked to the outer leg pipe.

Compared with the existing techniques, the technical solution has the following advantages.

The two supporting frames are disposed on the left side and the right side of the table board in a mirror-symmetrical manner, and the two supporting frames are disposed under the table board. The two supporting frames are placed on the ground. The table board can be opened to be used as an ordinary folding table and placed on the ground. After folding the two supporting frames and the table board, through the hook structure on the two supporting frames, the dual-purpose folding table can be hung on the wall to prevent the dual-purpose folding table from slipping on the ground, and does not occupy a space on the ground, and it is also convenient for the user to clean the floor. Furthermore, after hanging the dual-purpose folding table on the wall, the table board can be rotated upward to open the table board independently, and then the locking member or the stopping member can be used to lock the one or more sliding sleeves, so that the one or more supporting rods can support the table board to maintain the table board in the opened state. Therefore, the dual-purpose folding table has an advantage of being wall-mounted.

DETAILED DESCRIPTION OF THE EMBODIMENTS

Figure 1:
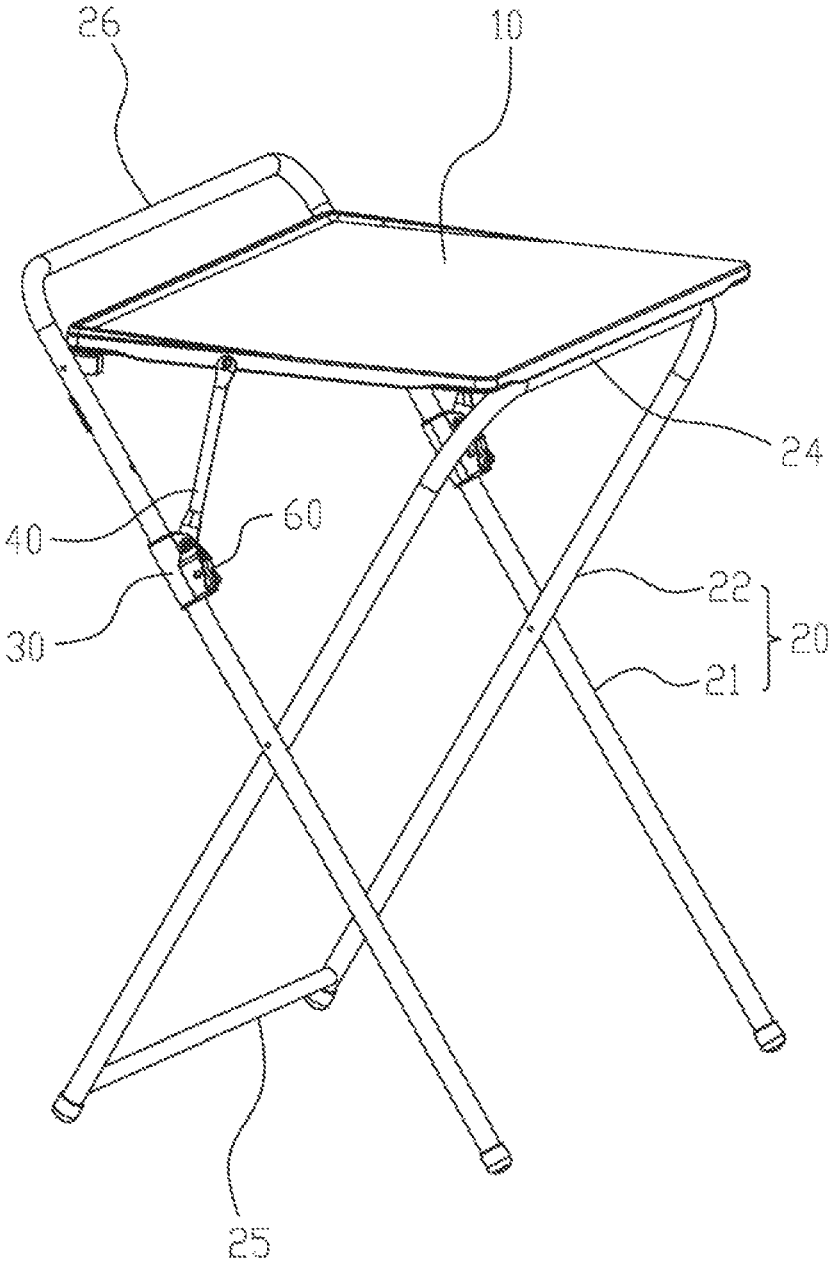
FIG. 1 illustrates a perspective view of a dual-purpose folding table of Embodiment 1, when the dual-purpose folding table is in an opened state.

The present disclosure will be further described below in combination with the accompanying drawings and embodiments.

Embodiment 1

Referring to FIGS. 1 to 10, a dual-purpose folding table is provided and comprises a table board 10 and two supporting frames 20 symmetrically disposed on a left side and a right side of the table board 10 and disposed under the table board 10. Each of the two supporting frames 20 comprises an outer leg pipe 21 and an inner leg pipe 22 connected to the outer leg pipe 21 in an X-shaped rotatable connection, and the inner leg pipe 22 is located inside of the outer leg pipe 21, so that when the two supporting frames 20 are in a folded state, the inner leg pipe 22 can be rotated to be in a plane on which the outer leg pipe 21 is disposed, and when the two supporting frames 20 are in an opened state, the table board 10 can be supported by the two supporting frames 20. An upper portion of the outer leg pipe 21 is pivotally connected to a rear portion of a corresponding side of the table board 10, and a front portion of a bottom surface of the table board 10 comprises a blocking portion 11 configured to correspond to the inner leg pipe 22. When the two supporting frames 20 are in the opened state, the blocking portion 11 is configured to inhibit movement of the inner leg pipe 22, and the outer leg pipe 21 and the inner leg pipe 22 are opened to be in an X-shaped connection. The two supporting frames 20 comprise a hook structure for hanging the dual-purpose folding table on a wall. One or more of the outer leg pipes 21 are respectively sleeved with one or more sliding sleeves 30 located above a rotation point at which the inner leg pipe 22 is connected to the outer leg pipe 21. One or more supporting rods 40 are connected between a middle portion of a side, which is adjacent to the one or more sliding sleeves 30, of the table board 10 and the one or more sliding sleeves 30, and two ends of the one or more supporting rods 40 are respectively pivotally connected to the one or more sliding sleeves 30 and the table board 10. The one or more sliding sleeves 30 are disposed with a locking member 50 for locking the one or more sliding sleeves 30 on the outer leg pipe 21. Since the one or more sliding sleeves 30 can slide on the outer leg pipe 21, when the two supporting frames 20 are maintained in a folded state, the table board 10 can be tilted independently with respect to the two supporting frames 20 to cause the one or more sliding sleeves 30 to slide upward. When the table board 10 is rotated to a desired angle, the locking member 50 is configured to enable the one or more sliding sleeves 30 to be fixed on the outer leg pipe 21, and the one or more supporting rods 40 are configured to support the table board 10 steadily.

Preferably, when the table board 10 is opened with respect to the outer leg pipe 21 90 degrees, the one or more sliding sleeves 30 are locked by the locking member 50, which conforms to usage habits. In a preferred embodiment, the one or more sliding sleeves 30 are automatically locked by the locking member 50.

Preferably, the locking member 50 is a plug pin movably disposed on the one or more sliding sleeves 30, and the outer leg pipe 21 comprises a positioning hole corresponding to the plug pin. When the table board 10 is rotated to a predetermined angle, the table board 10 drives the locking member 50 to slide with the one or more sliding sleeves 30 to a position of the positioning hole, so that the locking member 50 can be inserted into the positioning hole. Of course, the locking member 50 can also be a bolt, and the bolt can be screwed to the outer leg pipe 21 directly.

Preferably, the one or more sliding sleeves 30 are disposed with a button 60, and a middle portion of the button 60 is rotatably connected to the one or more sliding sleeves 30. The locking member 50 is connected to a first end of the button 60, and a spring 70 is disposed between a second end of the button 60 and the one or more sliding sleeves 30 to drive the button 60 to swing to drive the locking member 50 to be inserted into the positioning hole. In this way, when the table board 10 needs to be stored, the button 60 is first pressed to drive the locking member 50 to be pulled out from the positioning hole.

In this embodiment, the one or more sliding sleeves 30 are two sliding sleeves 30, and the one or more supporting rods 40 are two supporting rods 40. The two sliding sleeves 30 are respectively disposed on the two supporting frames 20, and the two supporting rods 40 are respectively connected the table board 10 and the two sliding sleeves 30. That is, the left side and the right side of the table board 10 are supported by the two supporting rods 40, so that the table board 10 is more secure after being opened.

Preferably, the hook structure is a hole 23 defined on the outer leg pipe 21, so that the dual-purpose folding table can be directly hung on screws on a wall. The blocking portion 11 is a groove structure and directly receives the inner leg pipe 22.

Preferably, upper portions of the inner leg pipes 22 of the two supporting frames 20 are connected to each other by an upper cross rod 24, and lower portions of the inner leg pipes 22 of the two supporting frames 20 are connected to each other by a lower cross rod 25, so that the blocking portion 11 directly inhibits movement of the upper cross rod 24 to inhibit the movement of the inner leg pipe 22. Upper portions of the outer leg pipes 21 of the two supporting frames 20 are connected to each other by a handrail rod 26, and the handrail rod 26 is higher than the table board 10. Of course, the handrail rod 26 can also be under the table board 10.

Embodiment 2

Figure 14:
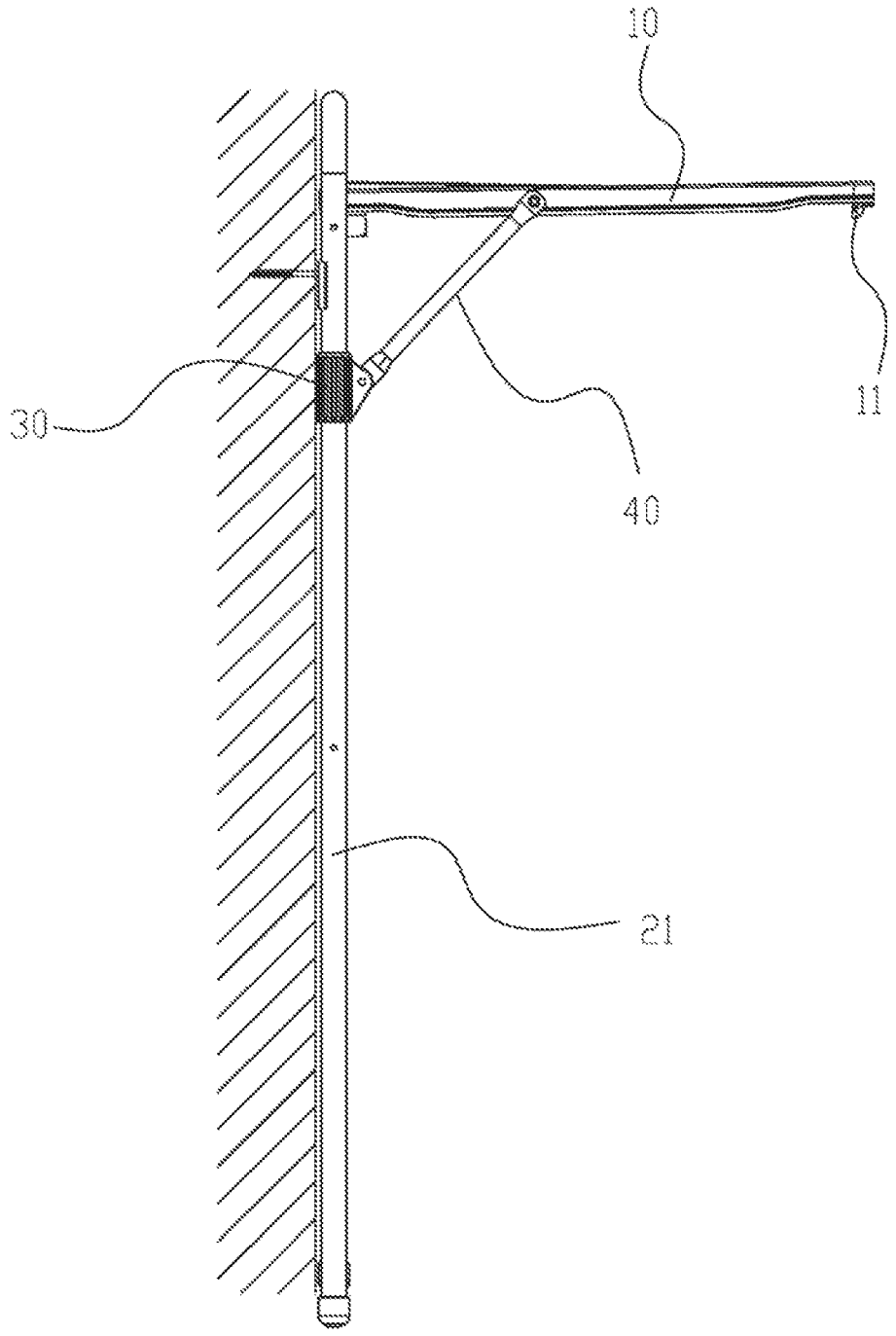
FIG. 14 illustrates a side view of the dual-purpose folding table of Embodiment 2, when the dual-purpose folding table is hung on the wall and a table board is opened to be in an opened state.
Figure 15:
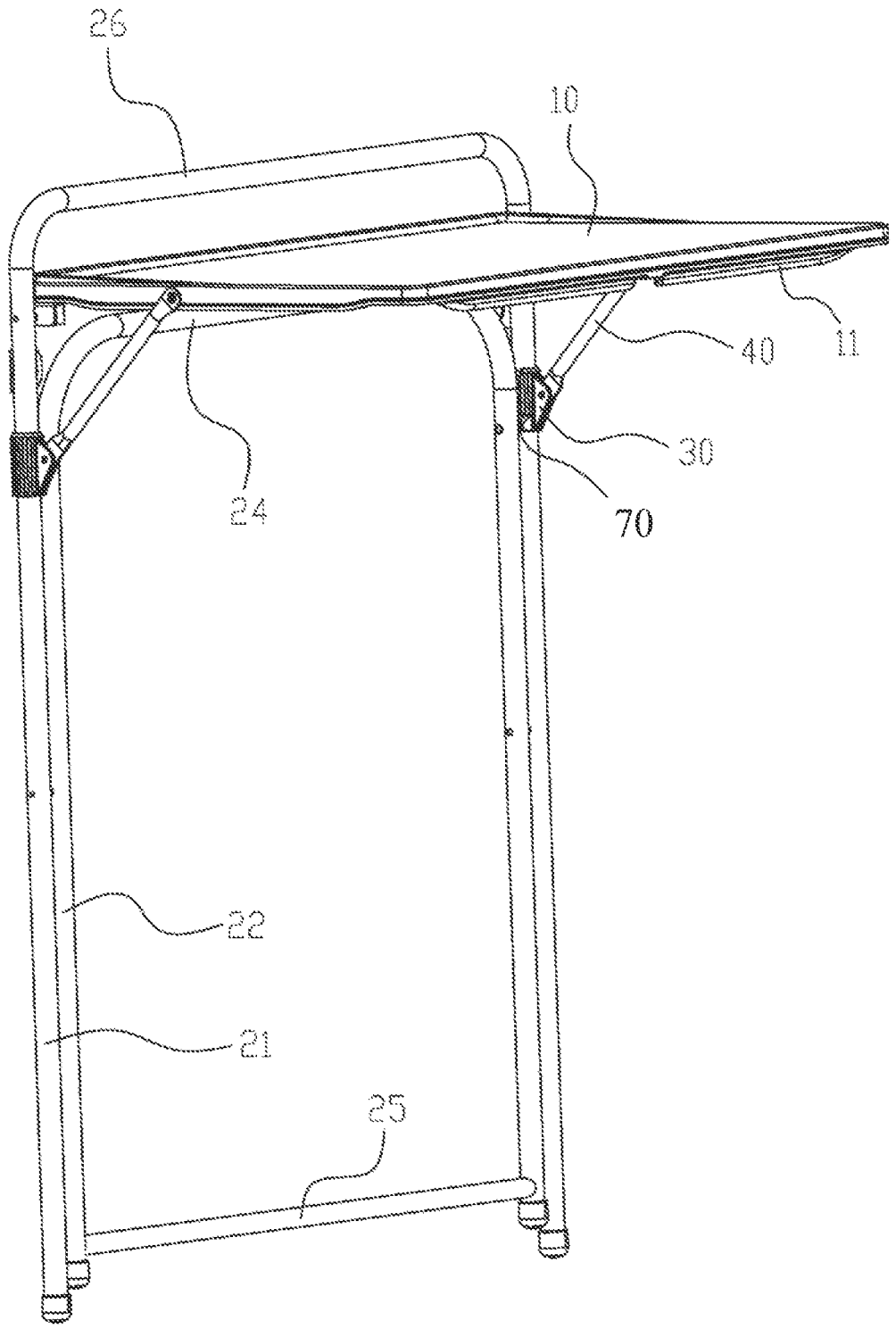
FIG. 15 illustrates a perspective view of the dual-purpose folding table of Embodiment 2, when the table board is independently opened to be in the opened state.
Figure 16:
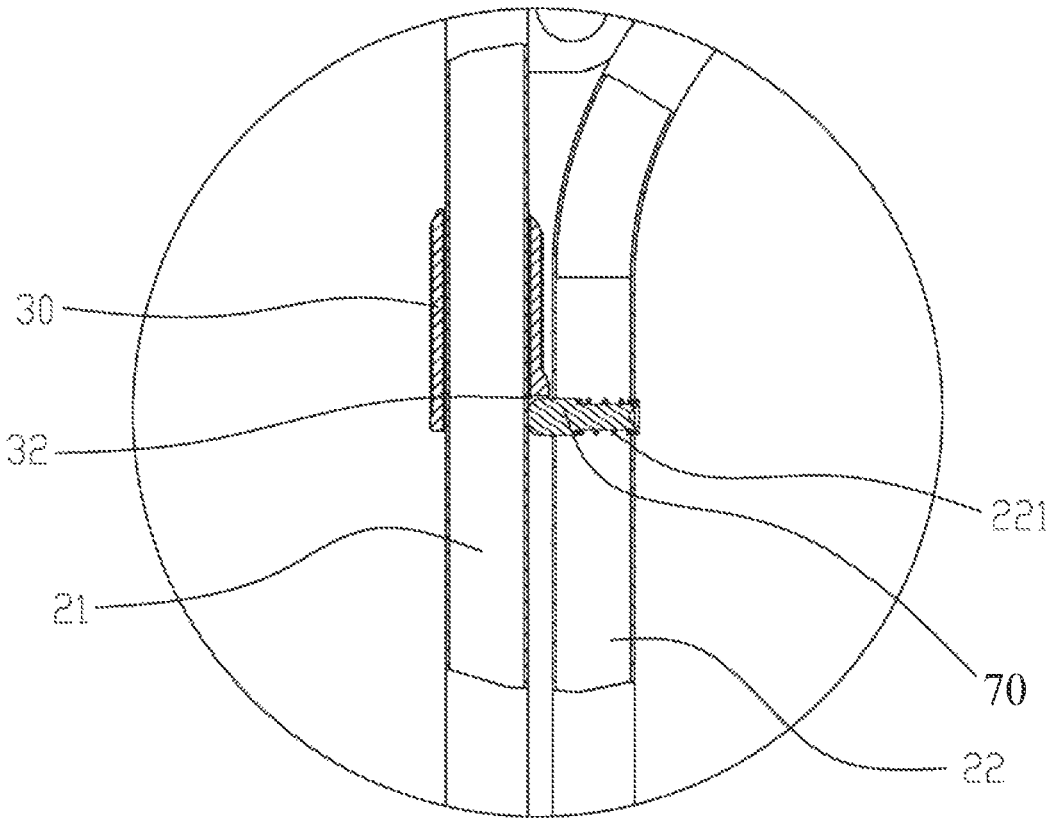
FIG. 16 illustrates a cross-sectional view of a stopping member being locked with one or more sliding sleeves in Embodiment 2.

The difference with the embodiment is described as follow. One or more of the outer leg pipes 21 are respectively sleeved with one or more sliding sleeves 30 located above a rotation point at which the inner leg pipe 22 is connected to the outer leg pipe 21. One or more supporting rods 40 are connected between a middle portion of a side, which is adjacent to the one or more sliding sleeves 30, of the table board 10 and the one or more sliding sleeves 30, and two ends of the one or more supporting rods 40 are respectively pivotally connected to the one or more sliding sleeves 30 and the table board 10. One or more of the inner leg pipes 22 that are respectively adjacent to the one or more sliding sleeves 30 are respectively disposed with one or more stopping members 70. Referring to FIGS. 14-15, when the two supporting frames 20 are in the folded state and the table board 10 is in an opened state, the one or more stopping members 70 is locked to the one or more sliding sleeves 30. Since the one or more sliding sleeves 30 can slide on the outer leg pipe 21, when the two supporting frames 20 are maintained in the folded state, the table board 10 can be independently opened to be tilted upward with respect to the two supporting frames 20, and the one or more sliding sleeves 30 slide upward. When the table board 10 is rotated to a desired angle, the one or more stopping members 70 are locked to the one or more sliding sleeves 30, so that the one or more supporting rods 40 can support the table board 10 steadily.

In this embodiment, the folded state of the two supporting frames 20 refers to the inner leg pipe 22 and the outer leg pipe 21 being rotated to the same plane, and the opened state of the two supporting frames 20 refers to the inner leg pipe 22 and the outer leg pipe 21 being rotated to be in the X-shaped connection to support the table board 10. In addition, the folded state of the table board 10 refers to the table board 10 being rotated downward to be in a vertical placement state, and the opened state of the table board 10 refers to the table board 10 being rotated upward to be substantially in a horizontal placement state.

Understandably, only when the two supporting frames 20 are in the folded state and the table board 10 is independently changed to be in the opened state, it is necessary for the one or more stopping members 70 to be locked to inhibit movement of the one or more sliding sleeves 30, so as to make the table board 10 in the opened state. In fact, when the two supporting frames 20 are in the opened state and placed on a ground, the two supporting frames 20 can support the table board 10 and keep the table board 10 in the open state. At this time, the one or more stopping members 70 do not need to inhibit the movement of the one or more sliding sleeves 30. Of course, at times when the one or more stopping members 70 inhibit the movement of the one or more sliding sleeves 30, the structure must be stronger.

Preferably, when the one or more stopping members 70 are in a locked connection with the one or more sliding sleeves 30, the one or more sliding sleeves 30 are inhibited from sliding downward on the outer leg pipe 21. The table board 10 in the opened state can bear weight. Part of the weight is transmitted to the one or more sliding sleeves 30 through the one or more supporting rods 40. The one or more stopping members 70 are located below the one or more sliding sleeves 30 to inhibit the movement of the one or more sliding sleeves 30, and the one or more stopping members 70 can support the table board 10 stably.

Preferably, each of the one or more stopping members 70 is a ball head movably disposed on the inner leg pipe 22, and the inner leg pipe 22 is disposed with a spring 221 for applying elastic force to the ball head. Further preferably, the spring 221 is disposed in the inner leg pipe 22.

Preferably, each of the one or more sliding sleeves 30 comprises a locking hole 32 corresponding to each of the one or more stopping members 70. Further preferably, the locking hole 32 is located at a lower portion of a side wall of each of the one or more sliding sleeves 30 and has an inverted U-shaped structure.

In this embodiment, the one or more sliding sleeves 30 are two sliding sleeves 30 respectively disposed on the outer leg pipes 21, and the one or more stopping members 70 are two locking members 50 respectively disposed on the inner leg pipes 22. That is, the left side and the right side of the table board 10 are all supported by the one or more supporting rods 40, so that the table board 10 is stronger after being opened.

Preferably, the wall hanging structure is a hole defined on the outer leg pipe 21. Further preferably, a corner piece 211 is disposed on the outer leg pipe 21, and the hole is defined on the corner piece 211. The hole is directly connected to the screws on the wall.

Preferably, upper portions of the inner leg pipes 22 of the two supporting frames 20 are connected to each other by an upper cross rod 24, and lower portions of the inner leg pipes 22 of the two supporting frames 20 are connected to each other by a lower cross rod 25, so that the blocking portion 11 directly inhibits movement of the upper cross rod 24 to inhibit the movement of the inner leg pipe 22. Upper portions of the outer leg pipes 21 of the two supporting frames 20 are connected to each other by a handrail rod 26, and the handrail rod 26 is higher than the table board 10. Of course, the handrail rod 26 can also be under the table board 10.

Figure 2:
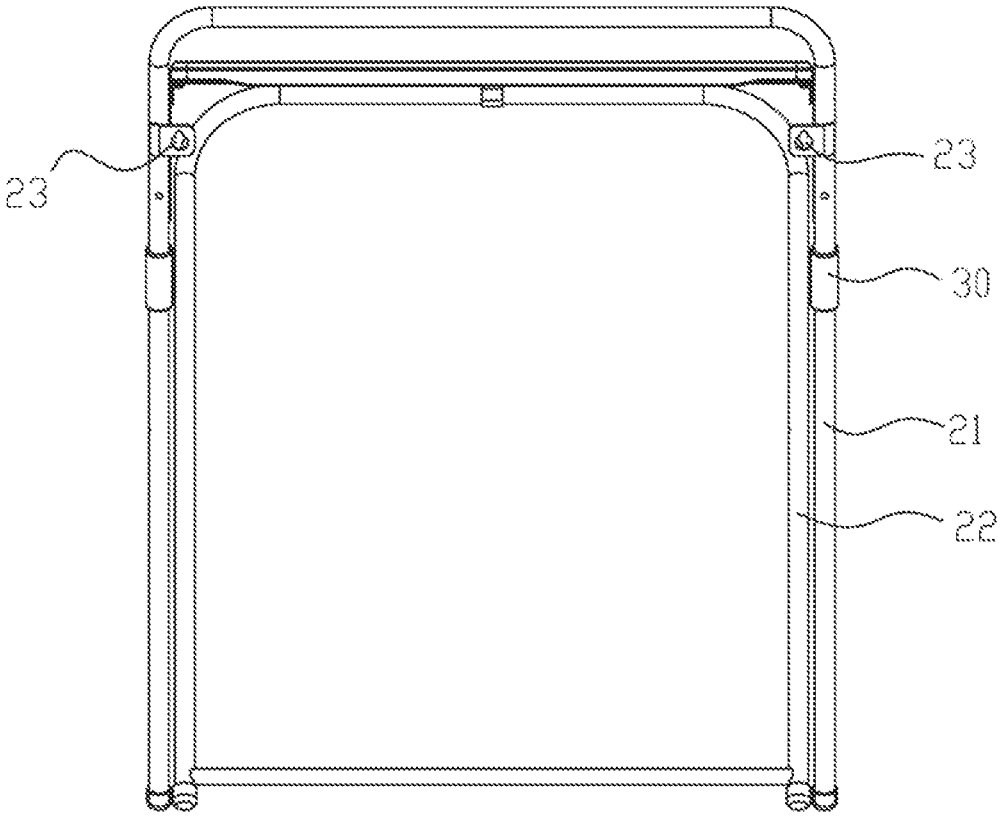
FIG. 2 illustrates a rear view of the dual-purpose folding table of Embodiment 1, when the dual-purpose folding table is in the opened state.
Figure 3:
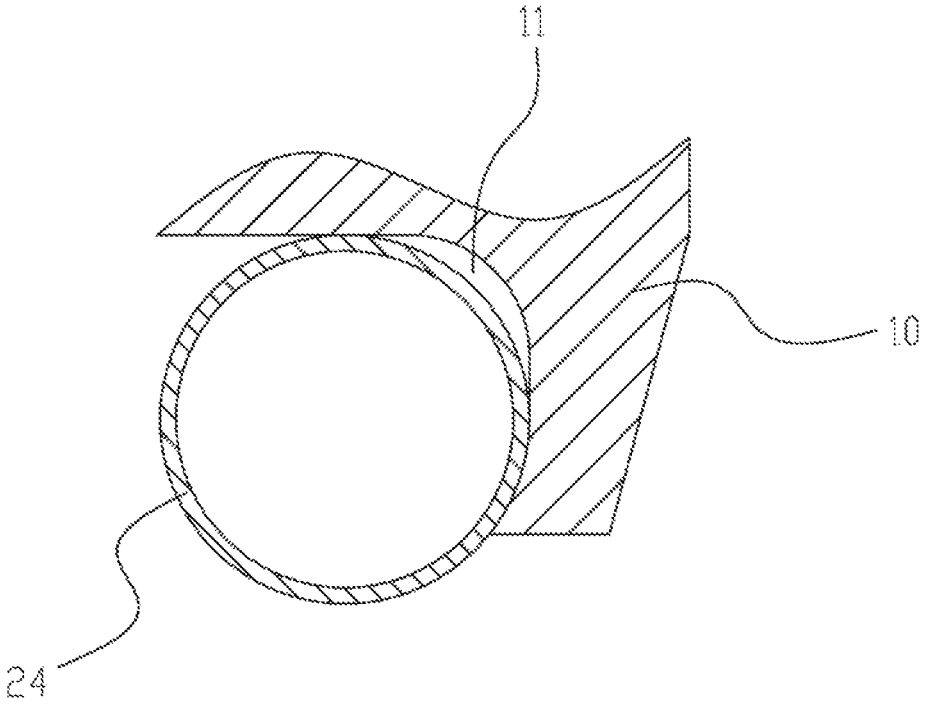
FIG. 3 illustrates a cross-sectional view of a blocking portion inhibiting movement of an upper cross rod in Embodiment 1.
Figure 4:
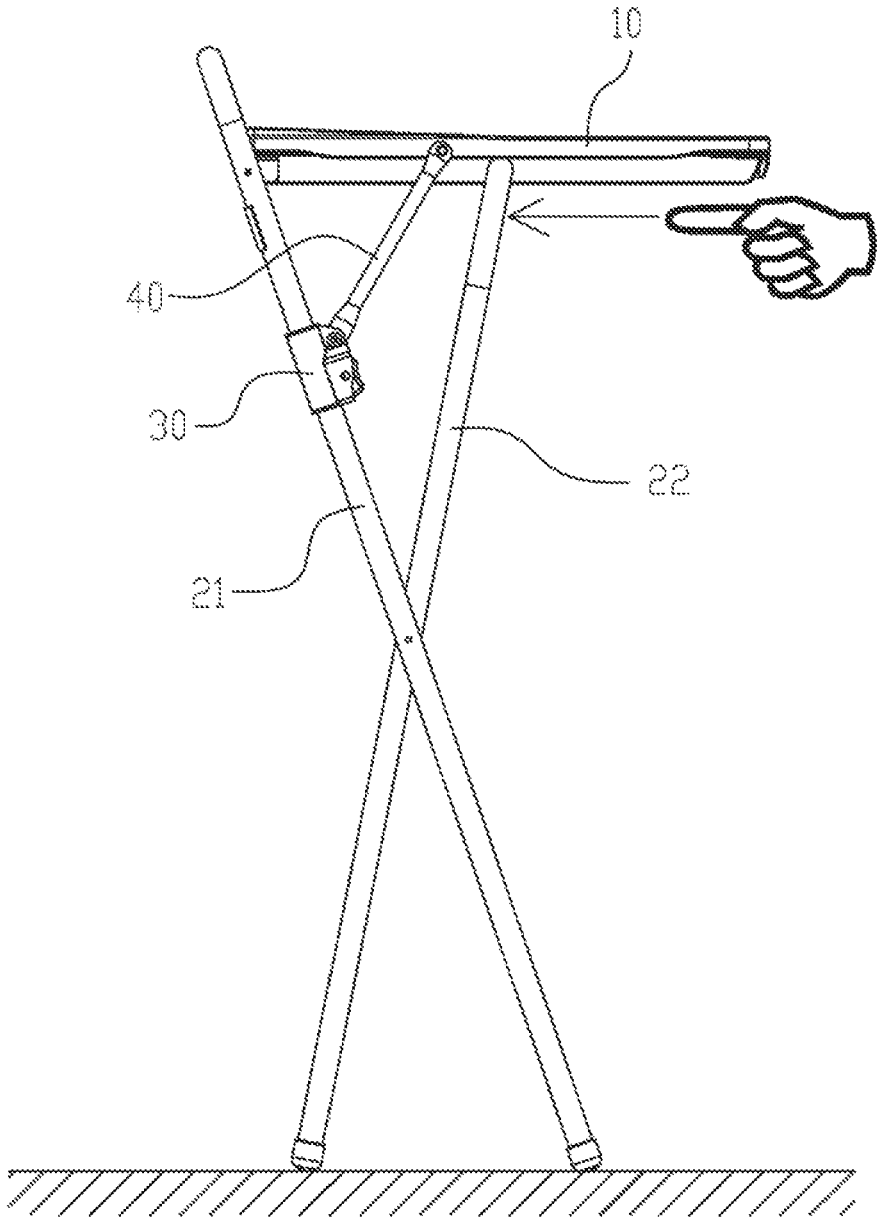
FIG. 4 illustrates a side view of the dual-purpose folding table of Embodiment 1, when the dual-purpose folding table is in a folding process.
Figure 5:
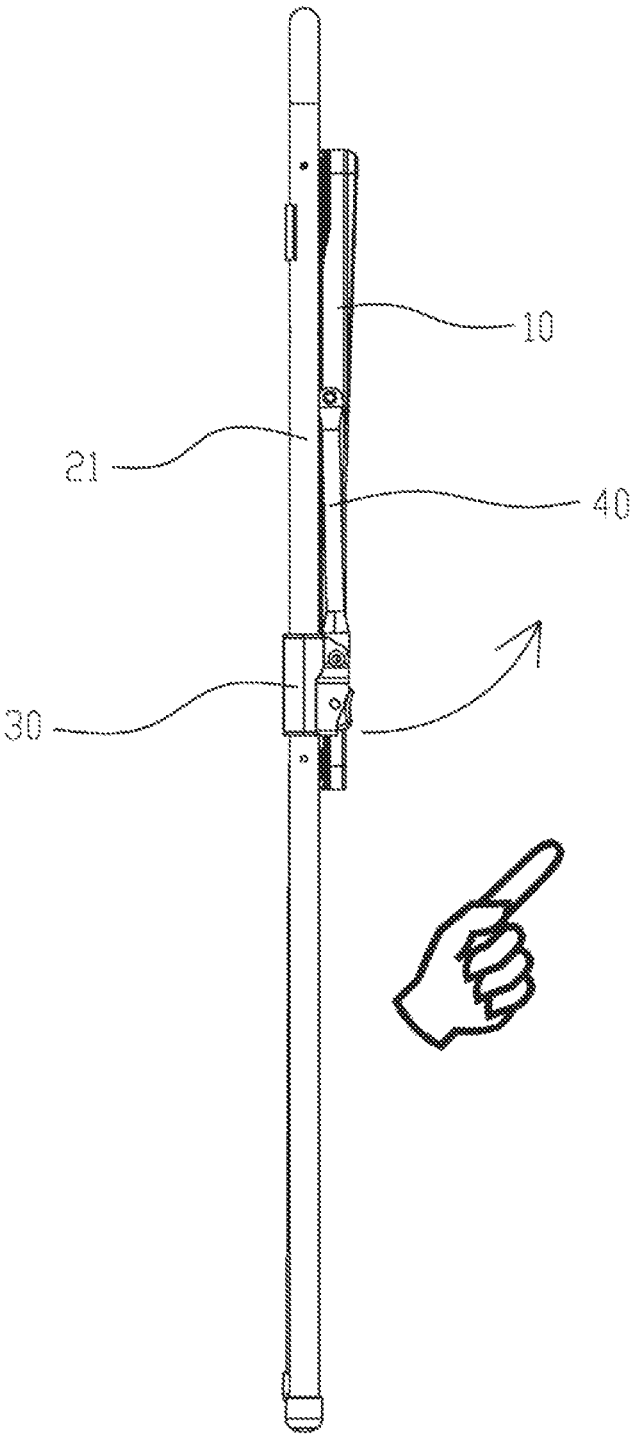
FIG. 5 illustrates a side view of the dual-purpose folding table of Embodiment 1, when the dual-purpose folding table is in a folded state.
Figure 6:
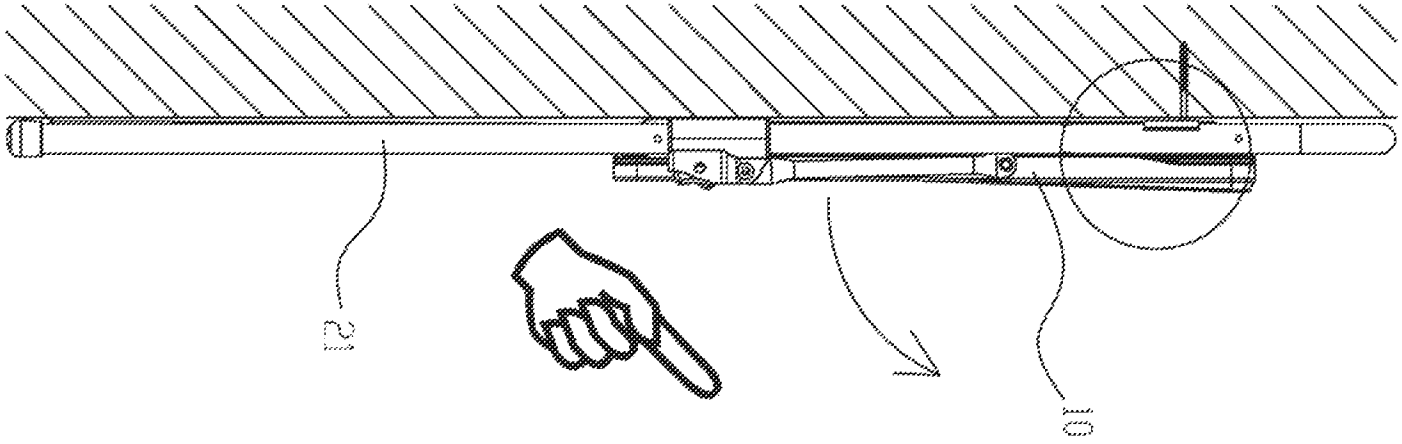
FIG. 6 illustrates a side view of the dual-purpose folding table of Embodiment 1, when the dual-purpose folding table is hung on a wall.
Figure 7:
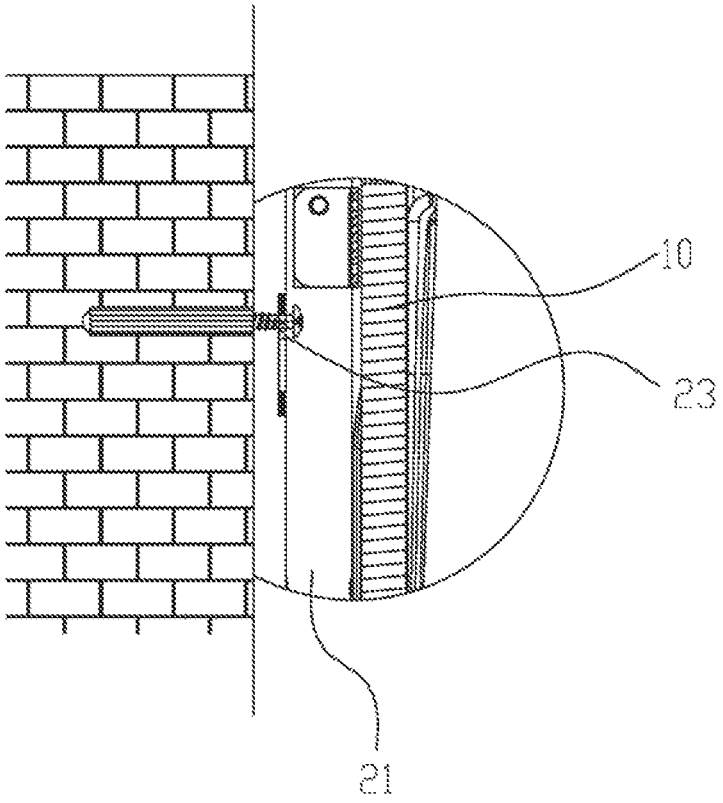
FIG. 7 illustrates a cross-sectional view of an enlarged view of a circle in FIG. 6.
Figure 8:
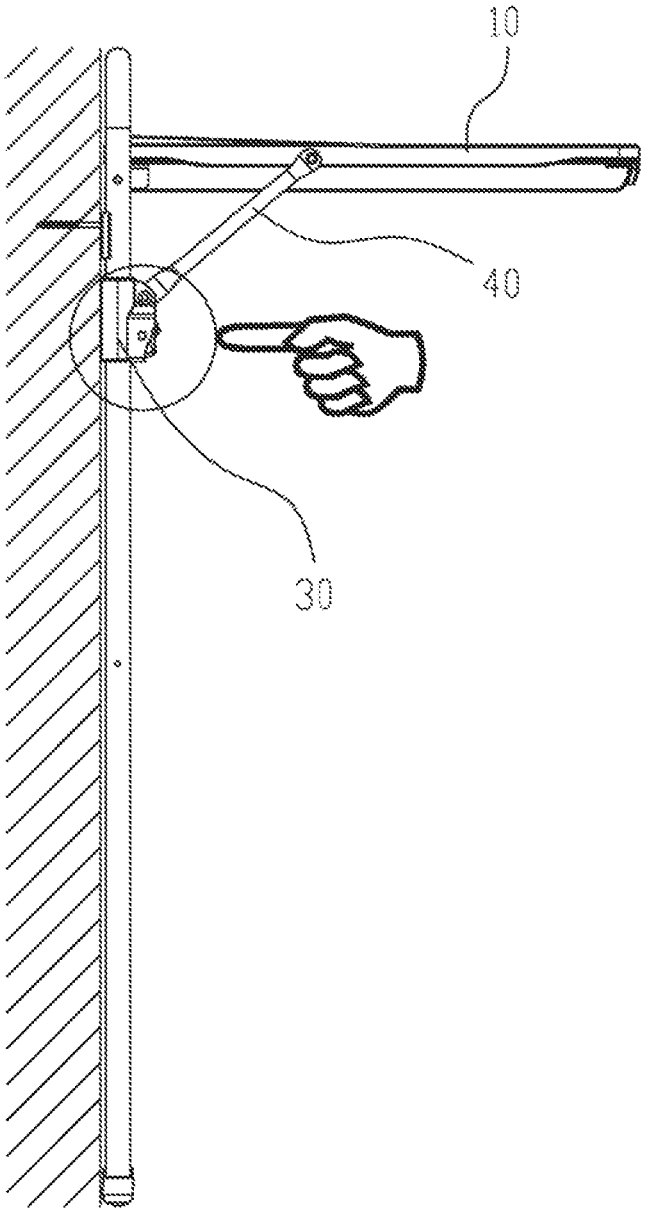
FIG. 8 illustrates a side view of the dual-purpose folding table of Embodiment 1, when the dual-purpose folding table is hung on the wall and a table board is independently opened to be in an opened state.
Figure 9:
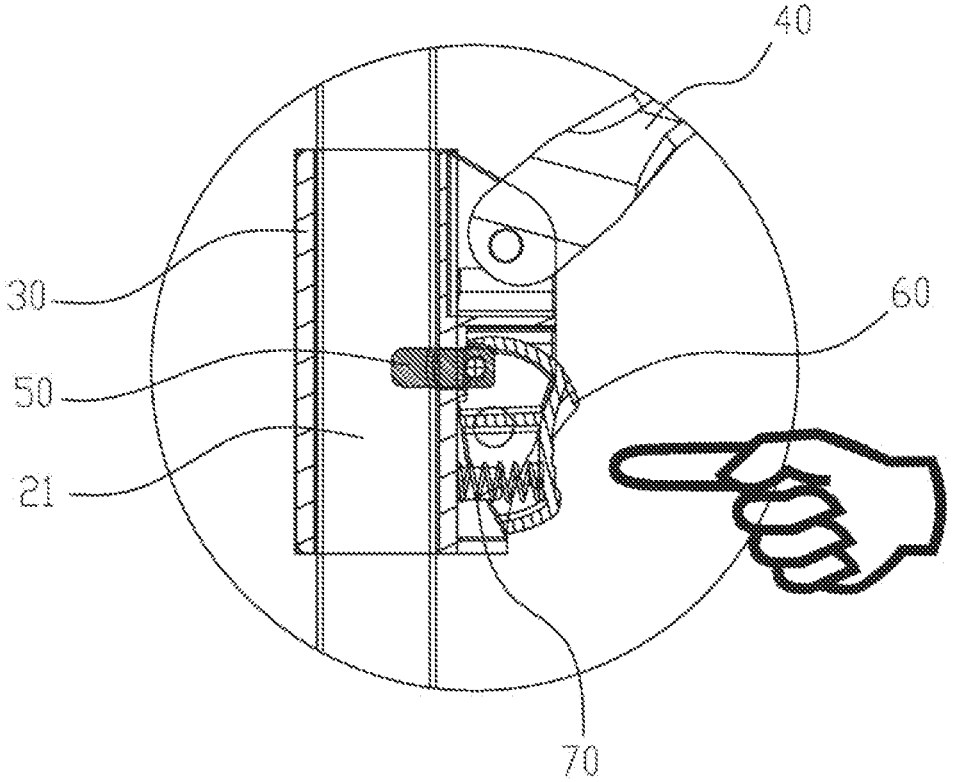
FIG. 9 illustrates a cross-sectional view of an enlarged view of a circle in FIG. 8.
Figure 10:
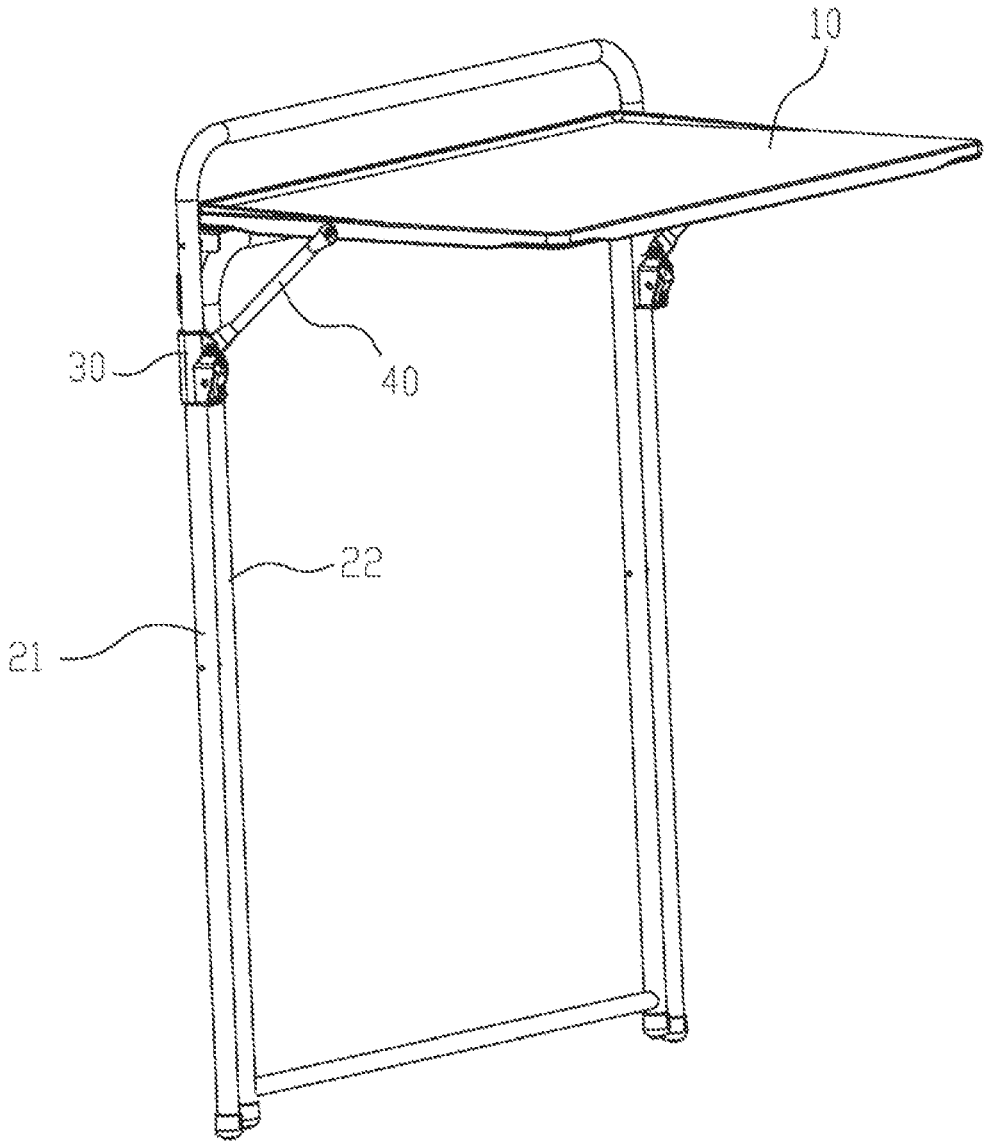
FIG. 10 illustrates a perspective view of the dual-purpose folding table of Embodiment 1, when the table board is independently opened to be in an opened state.
Figure 11:
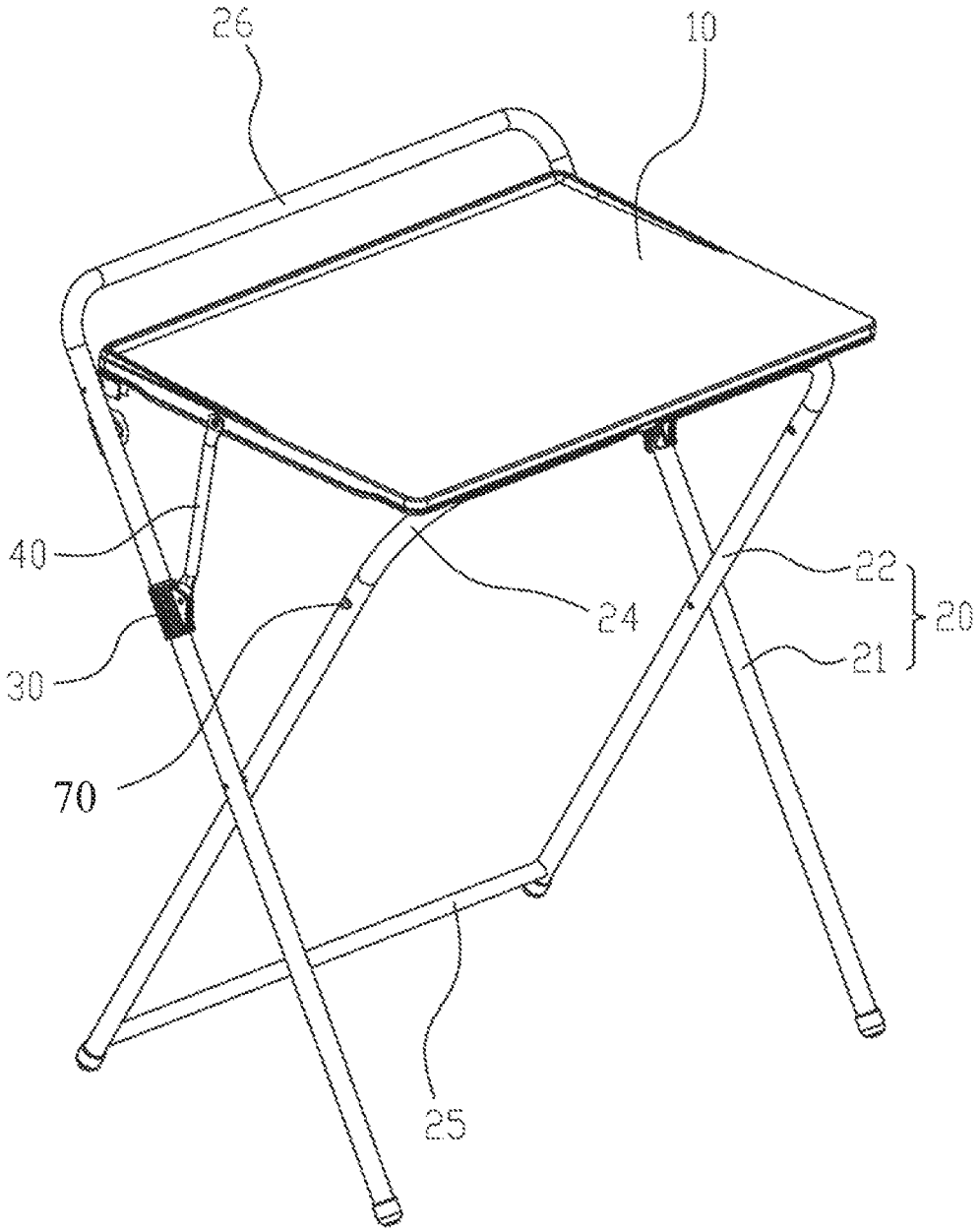
FIG. 11 illustrates a perspective view of a dual-purpose folding table of Embodiment 2, when the dual-purpose folding table is in an opened state and placed on the ground.
Figure 12:
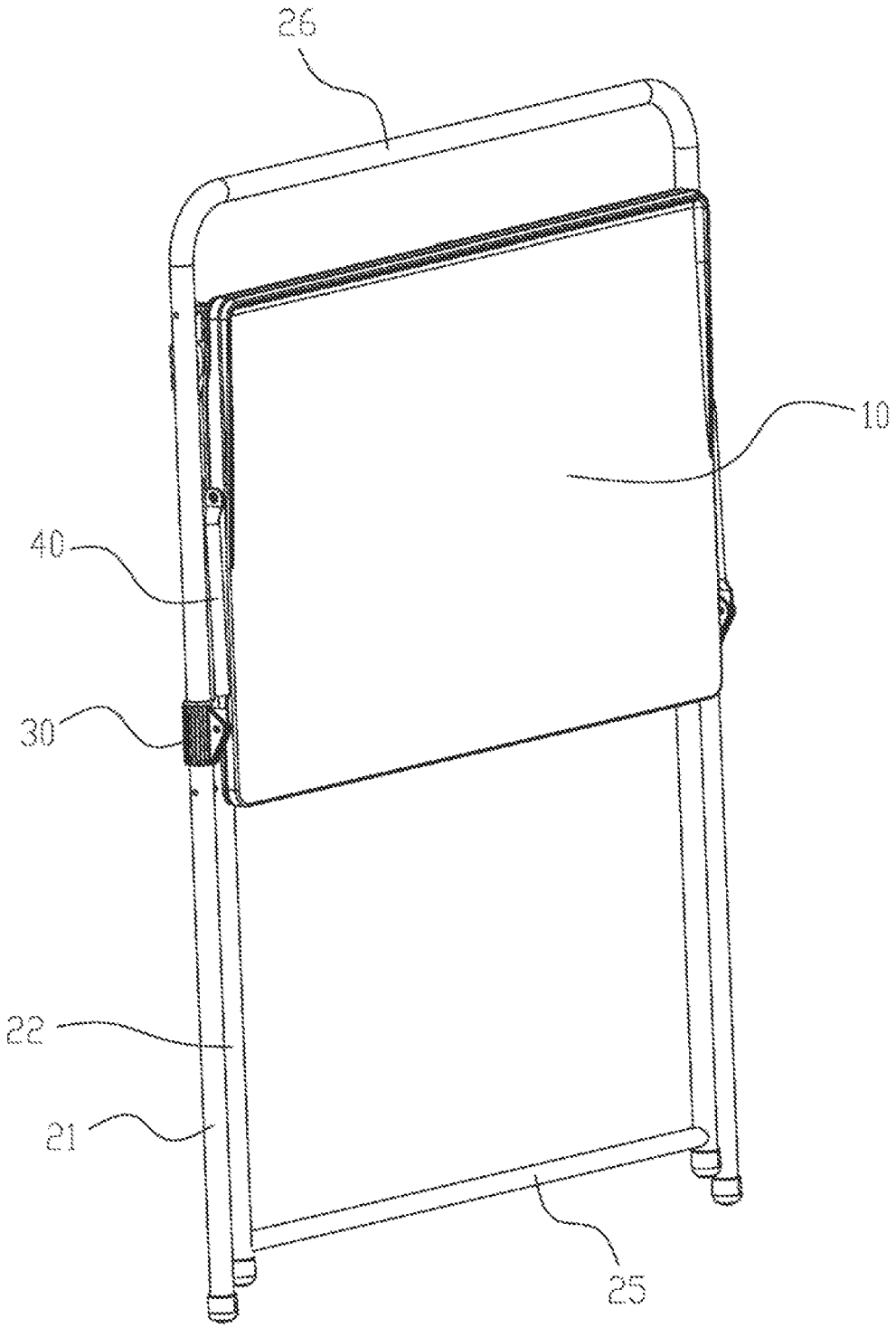
FIG. 12 illustrates a perspective view of the dual-purpose folding table of Embodiment 2, when the dual-purpose folding table is in a folded state.
Figure 13:
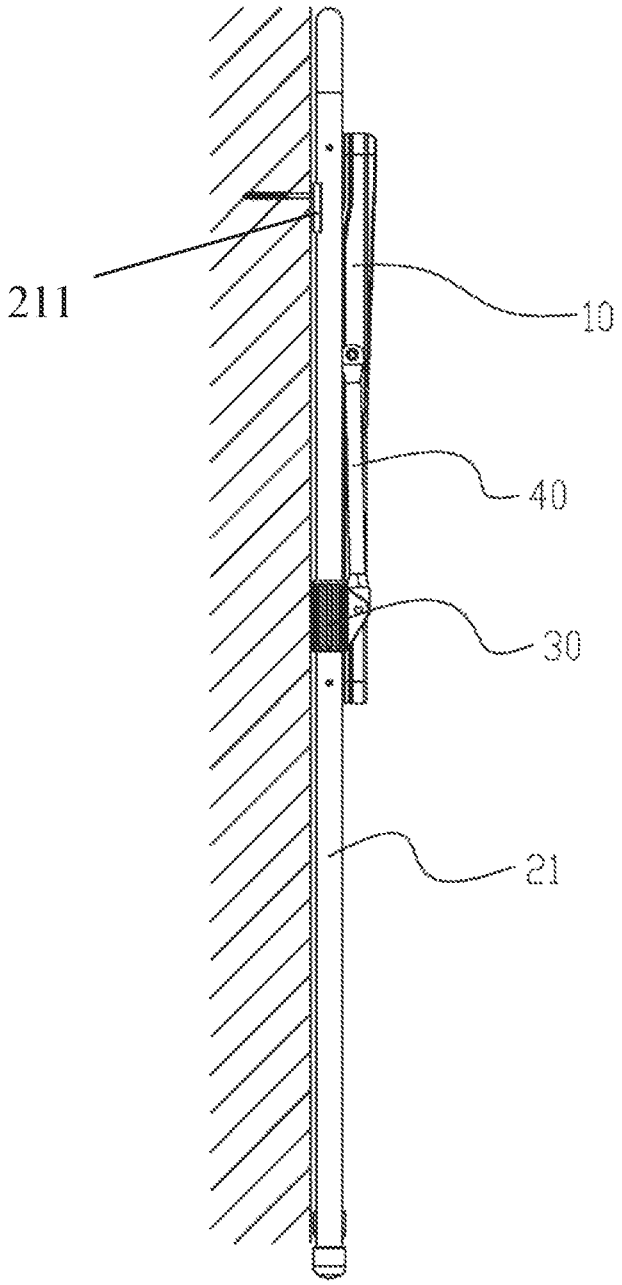
FIG. 13 illustrates a side view of the dual-purpose folding table of Embodiment 2, when the dual-purpose folding table is in the folded state and is hung on the wall.
Figure 17:
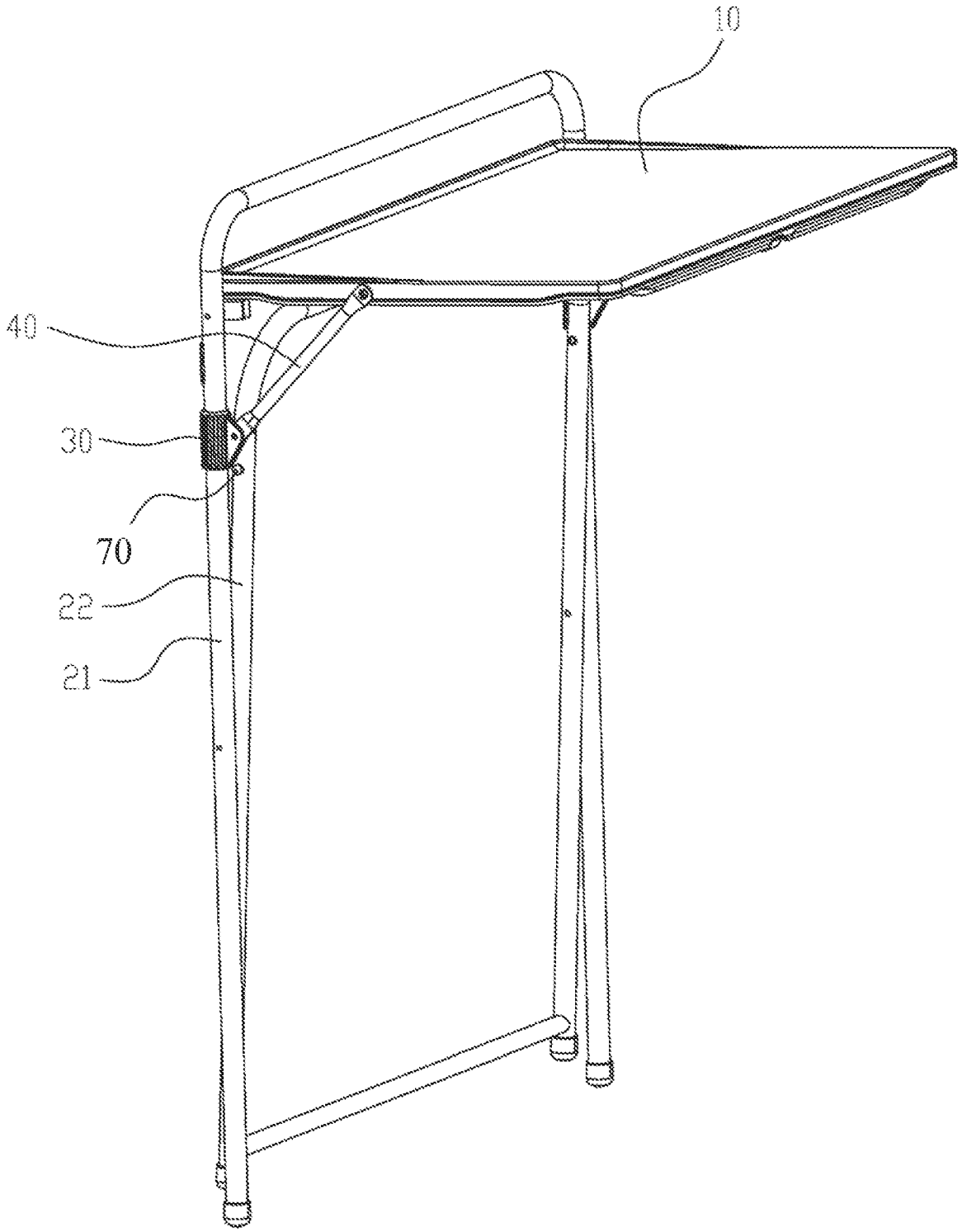
FIG. 17 illustrates a first perspective view of the dual-purpose folding table of Embodiment 2, when the table board is tilted upward and the stopping member is separated from the one or more sliding sleeves.
Figure 18:
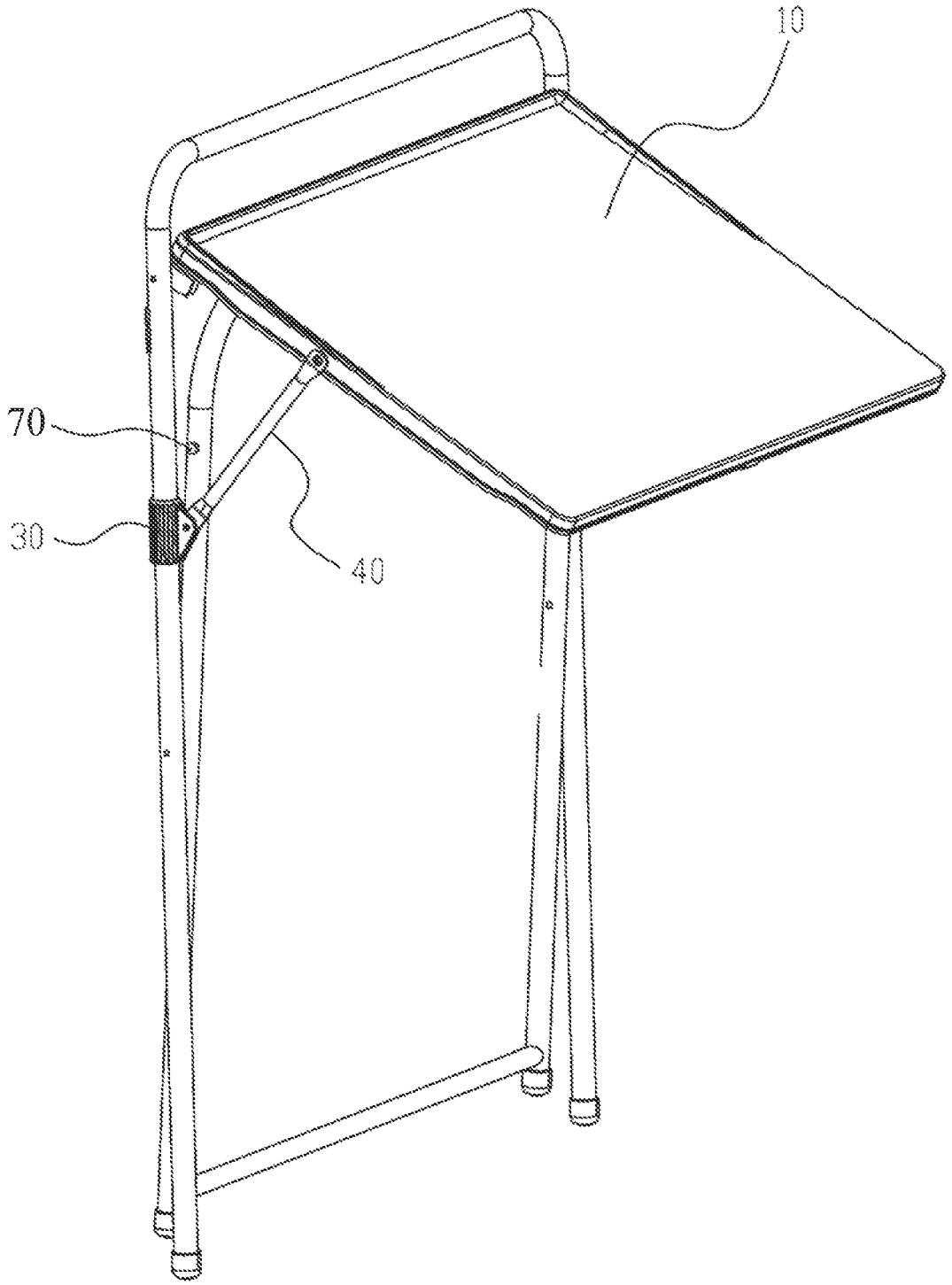
FIG. 18 illustrates a second perspective view of the dual-purpose folding table of Embodiment 2, when the table board is tilted upward and the stopping member is separated from the one or more sliding sleeves.

During use, when the table board 10 and the two supporting frames 20 are in the opened state, the dual-purpose folding table can be placed on the ground and used as an ordinary table, as shown in FIG. 11. When the table board 10 and the two supporting frames 20 are in the folded state, the dual-purpose folding table can be placed on the wall, as shown in FIGS. 2 and 3. When the dual-purpose folding table is hung on the wall, the table board 10 can be independently opened to enable the one or more stopping members 70 to be locked to the one or more sliding sleeves 30, so that the table board 10 can be stably in the opened state and the dual-purpose folding table can be hung on the wall for use, as shown in FIGS. 4-5. When the table board 10 needs to be taken down, the table board 10 can be lifted up first, so that the one or more sliding sleeves 30 are moved up by the one or more supporting rods 40, the one or more stopping members 70 are separated from the locking hole 32, and then the inner leg pipe 22 is slightly opened to move the one or more stopping members 70 away from its original position, as shown in FIG. 17. At this time, when the table board 10 is rotated downward for storage, since the one or more stopping members 70 are not in their original position, the one or more sliding sleeves 30 can slide down smoothly, as shown in FIG. 18, until the table board 10 is completely folded. Of course, if the table board 10 is not folded, the one or more sliding sleeves 30 are moved up to be separated from the one or more stopping members 70, and then the inner leg pipe 22 can be opened. That is, the two supporting frames 20 are fully opened, and then the table board 10 is opened to be used as an ordinary table.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A dual-purpose folding table, comprising:

a table board, and two supporting frames, wherein:

the two supporting frame are symmetrically disposed on a left side and a right side of the table board, each of the two supporting frames comprises an outer leg pipe and an inner leg pipe connected to the outer leg pipe in an X-shaped rotatable connection, an upper portion of the outer leg pipe is pivotally connected to a rear portion of a corresponding side of the table board, a front portion of a bottom surface of the table board comprises a blocking portion, the two supporting frames comprise a hook structure, the outer leg pipe of at least one of the two supporting frames is respectively sleeved with a sliding sleeve located above a rotation point at which the inner leg pipe is connected to the outer leg pipe, a supporting rod is connected between a middle portion of a side, which is adjacent to the sliding sleeve, of the table board and the sliding sleeve, two ends of the supporting rod are respectively pivotally connected to the sliding sleeve and the table board, an upper portion of the inner leg pipe of one of the two supporting frames is connected to an upper portion of the inner leg pipe of the other one of the two supporting frames by an upper cross rod, when the table board is unfolded to be in a first unfolded state:

the two supporting frames are in an unfolded state, the sliding sleeve is separated from the outer leg pipe, and the upper cross rod is hooked to the blocking portion to inhibit movement of the inner leg pipe, and when the table board is unfolded to be in a second unfolded state:

the two supporting frames are in a folded state, the upper cross rod is separated from the blocking portion, and the sliding sleeve is locked to the outer leg pipe.

2. The dual-purpose folding table according to claim 1, wherein:

the sliding sleeve is disposed with a locking member, and when the table board is unfolded with respect to the outer leg pipe 90 degrees, the sliding sleeve is locked by the locking member.

3. The dual-purpose folding table according to claim 2, wherein:

the locking member is a plug pin movably disposed on the sliding sleeve, and the outer leg pipe comprises a positioning hole corresponding to the plug pin.

4. The dual-purpose folding table according to claim 3, wherein:

the sliding sleeves comprises a button, a middle portion of the button is rotatably connected to the sliding sleeve, the locking member is connected to a first end of the button, a spring is disposed between a second end of the button and the sliding sleeve to drive the button to swing to drive the locking member to be disposed in the positioning hole.

5. The dual-purpose folding table according to claim 1, wherein:

the outer leg pipe of each of the two supporting frames comprises the sliding sleeves.

6. The dual-purpose folding table according to claim 1, wherein:

the hook structure is a hole defined on the outer leg pipe, and the blocking portion is a groove structure.

7. The dual-purpose folding table according to claim 6, wherein:

a lower portion of the inner leg pipe of one of the two supporting frames is connected to a lower portion of the inner leg pipe of the other one of the two supporting frames by a lower cross rod.

8. The dual-purpose folding table according to claim 1, wherein:

the upper portion of the outer leg pipe of one of the two supporting frames is connected to the upper portion of the outer leg pipe of the other one of the two supporting frames by a handrail rod.

9. The dual-purpose folding table according to claim 8, wherein:

the handrail rod is higher than the table board.

10. The dual-purpose folding table according to claim 1, wherein:

the inner leg pipes comprises a stopping member, and when the two supporting frames are in the folded state and the table board is in the second unfolded state, the stopping member is locked to the sliding sleeve.

11. The dual-purpose folding table according to claim 10, wherein:

the stopping member is a ball head movably disposed on the inner leg pipe, and the inner leg pipe is disposed with a spring for applying elastic force to the ball head.

12. The dual-purpose folding table according to claim 11, wherein:

the spring is disposed in the inner leg pipe.

13. The dual-purpose folding table according to claim 10, wherein:

the blocking portion is a groove structure corresponding to the upper cross rod, a lower portion of the inner leg pipe of each of the two supporting frames is connected to a lower portion of the inner leg pipe of the other one of the two supporting frames by a lower cross rod, the upper portion of the outer leg pipe of one of the two supporting frames is connected to the upper portion of the outer leg pipe of the other one of the two supporting frames by a handrail rod, and the handrail rod is higher than the table board.

* * * * *